US007108669B2

(12) United States Patent
Huang

(10) Patent No.: US 7,108,669 B2
(45) Date of Patent: Sep. 19, 2006

(54) MASSAGER

(76) Inventor: Chien-Ming Huang, 11-1 Fl., No. 23, Sec. 2, Keelung Rd., Taipei (TW)

( * ) Notice: Subject to any disclaimer, the term of this patent is extended or adjusted under 35 U.S.C. 154(b) by 9 days.

(21) Appl. No.: 10/954,325

(22) Filed: Sep. 29, 2004

(65) Prior Publication Data

US 2006/0069331 A1 Mar. 30, 2006

(51) Int. Cl.
*A61H 7/00* (2006.01)

(52) U.S. Cl. ..... 601/94; 601/90; 601/134

(58) Field of Classification Search ..... 601/84, 601/86, 87, 89, 90, 93–95, 97, 98, 10, 100, 601/103, 104, 107, 108, 110, 111–112, 116, 601/126, 133, 134

See application file for complete search history.

(56) References Cited

U.S. PATENT DOCUMENTS 4,016,872 A * 4/1977 Yamamura et al. ..... 601/118
6,099,487 A * 8/2000 Chen ..... 601/90
6,599,261 B1 * 7/2003 Chen ..... 601/115
6,629,940 B1 * 10/2003 Shimizu ..... 601/133
6,837,861 B1 * 1/2005 Lin ..... 601/87
6,969,361 B1 * 11/2005 Hsieh ..... 601/127

* cited by examiner

*Primary Examiner*—Quang D. Thanh
(74) *Attorney, Agent, or Firm*—Dellett & Walters patenttm.us

(57) ABSTRACT

A massager has a base, a U shaped housing mounted on the base, a motor received in the housing and having a worm shaft extending out of the motor, a transmission assembly encased in the housing and including a transmission axle, a worm gear, two wobbling wheels mounted on the transmission axle and two kneading plates mounted on the transmission axle and a rubbing assembly having two disks respectively mounted on a free end of each of two driven axles and having two rubbing balls formed on a face of each of the disks.

8 Claims, 7 Drawing Sheets

MASSAGER

BACKGROUND OF THE INVENTION

1. Field of the Invention

The present invention relates to a massager, and more particularly to a multiple-function massager having a pair of kneading plates respectively and eccentrically mounted on a transmission axle and a pair of rubbing balls driven by the transmission axle such that the user is able to apply the massager to a designated area and enjoy the massaging effect not only to the designated area but also to a nearby area.

2. Description of Related Art

A conventional massager comprises a motor, a pair of linkages and a pair of massage balls. The linkages are eccentrically connected to opposite ends of the motor shaft. Each of the massage balls is securely engaged with one of the linkages. Because the linkages are eccentrically engaged with the motor shaft, the motor will thus drive and move the linkages. That is, the rotational movement of the motor shaft will be transformed into reciprocating movement of the linkage. Accordingly, the massage balls securely mounted on the linkages will move up and down. When the massager is applied against the user's skin, the up and down movement of the balls generates a massage effect to the user.

However, the massaging effect generated by the monotonous up and down movement of the balls can only be applied to a single limited area. When the user wants to apply the massager to a nearby area, the user will have to move the massager of this kind to the designated nearby area. Therefore, not only is the massage effect not as good as expected, but also using this massager is troublesome.

To overcome the shortcomings, the present invention tends to provide an improved multiple-function massager to mitigate and obviate the aforementioned problems.

SUMMARY OF THE INVENTION

The primary objective of the present invention is to provide a massager that has a pair of kneading plates and a pair of rubbing balls. The kneading plates are eccentrically mounted on a transmission axle in connection with a worm shaft and the rubbing balls are driven by the transmission axle. Therefore, the user is able to enjoy two different massaging effects in an area.

Other objects, advantages and novel features of the invention will become more apparent from the following detailed description when taken in conjunction with the accompanying drawings.

DETAILED DESCRIPTION OF PREFERRED EMBODIMENT

Figure 1:
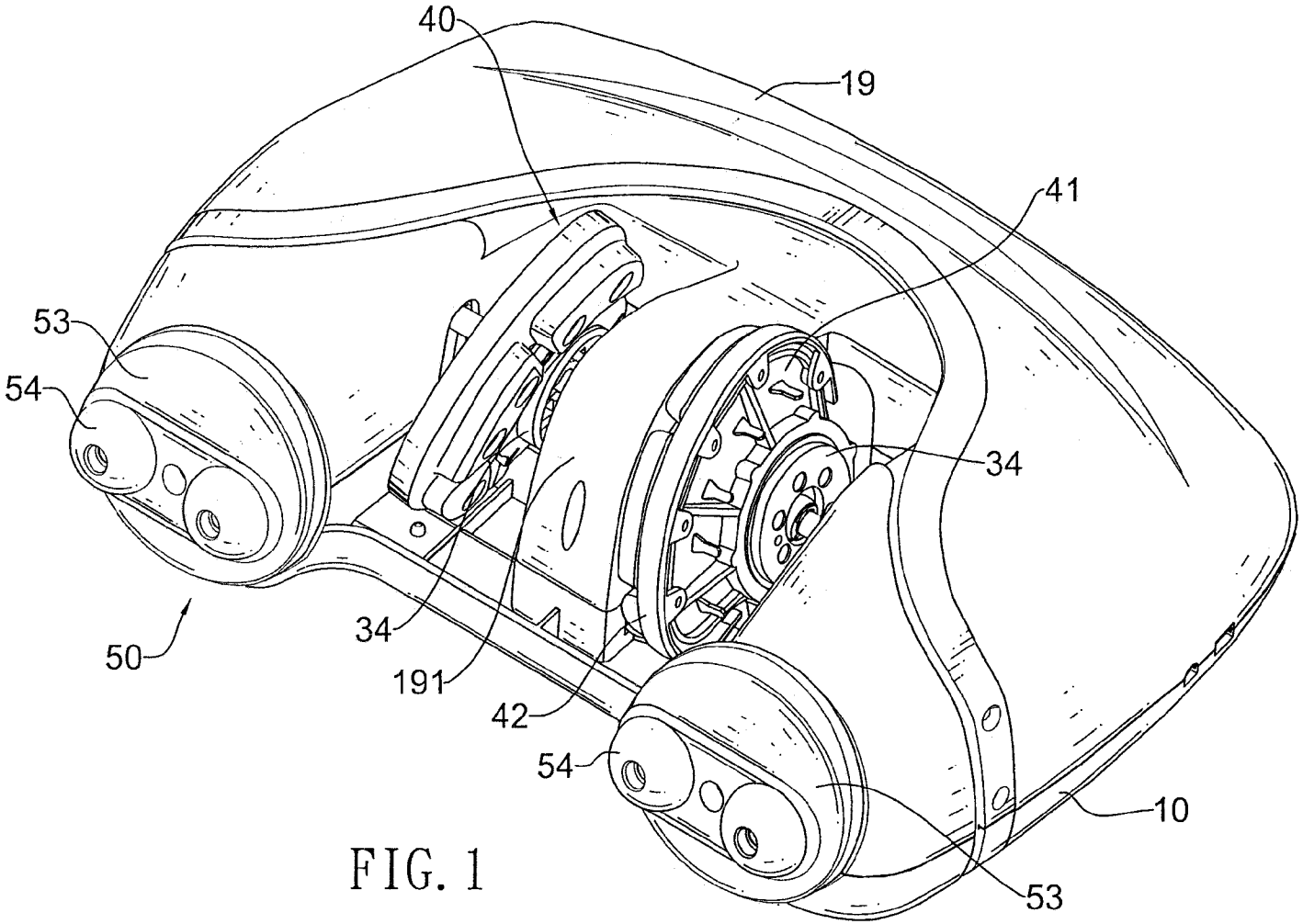
FIG. 1 is a perspective view showing the appearance of the massager of the present invention.
Figure 2:
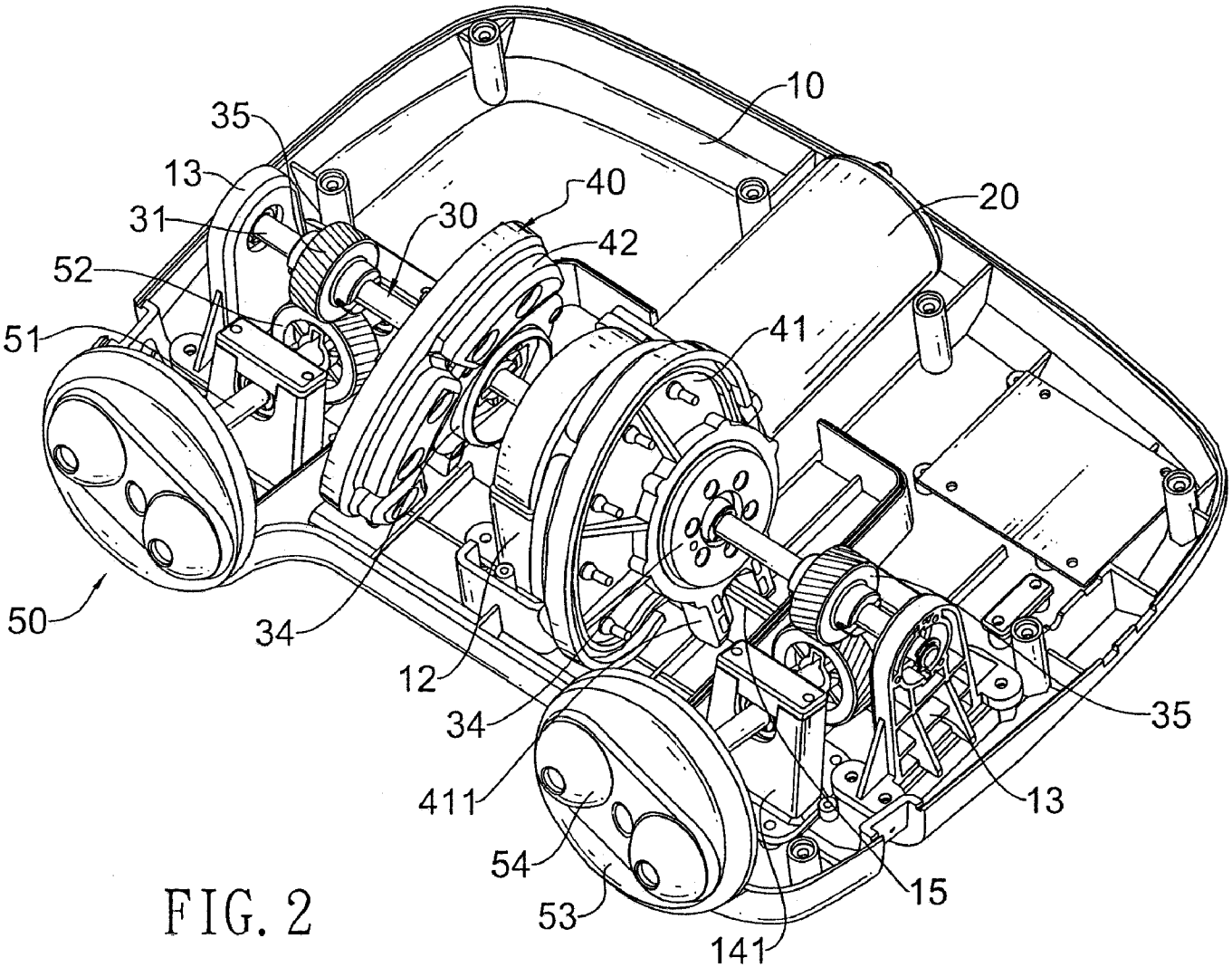
FIG. 2 is a perspective view of the massager in FIG. 1 with the casing removed.

With reference to FIGS. 1 and 2, the massager in accordance with the present invention has a substantially U-shaped housing (19) with a hollow protrusion (191) formed in a mediate portion of the housing (19) to divide the housing (19) into a first receiving space and a second receiving space to respectively receive therein a kneading assembly (40). Furthermore, the housing (19) has two ends each provided with a rubbing assembly (50).

Figure 3:
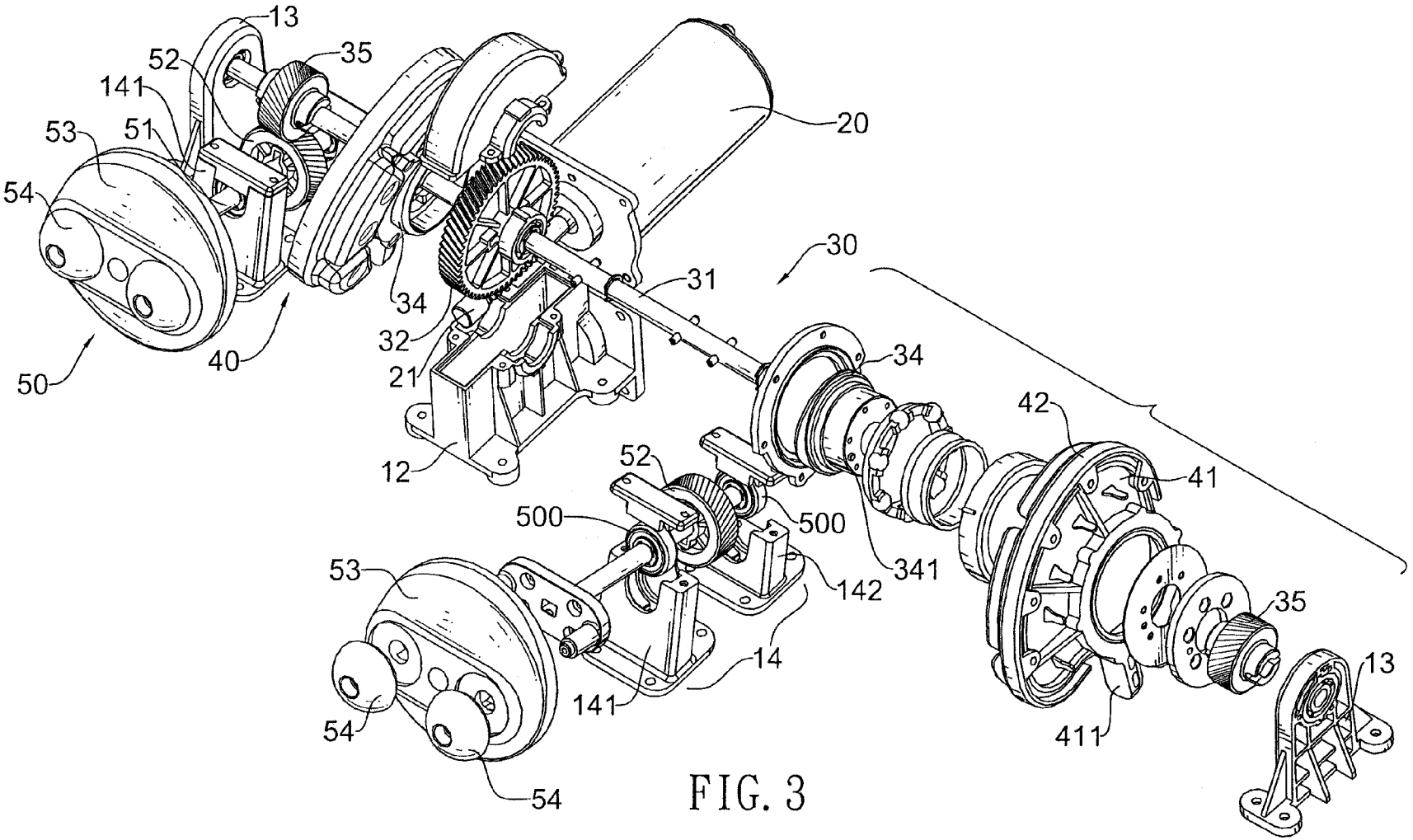
FIG. 3 is an exploded perspective view of the internal structure of the massager of the present invention.

With reference to FIGS. 2 and 3, the base (10) is further provided with a central seat (12) integrally formed on a central area of the housing (10), two side seats (13) respectively mounted on opposed sides of the central seat (12) and two mediate seats (14) respectively sandwiched between the central seat (12) and the side seat (13). The central seat (12) is provided with a first space (121) to receive therein a worm gear (32) of a transmission assembly (30). Each mediate seat (14) is provided with a front seat (141) and a rear seat (142). The base (10) is further provided with two guiding tracks (15) respectively formed on opposed sides of the central seat (12). The transmission assembly (30) includes a transmission axle (31) having the worm gear (32) securely and fixedly mounted around the transmission axle (31) to be received in the first space (121) of the central seat (12) and the hollow protrusion (191), two wobbling wheels (34) securely and fixedly mounted around the transmission axle (31) on two opposed sides of the worm gear (32) and each wobbling wheel (34) is provided with a sleeve (341) securely and eccentrically connected to the wobbling wheel (34) and a driving gear (35) securely and fixedly mounted around the transmission axle (31) and located between the central seat and the mediate seat (14).

The kneading assembly (40) includes two kneading plates (41) respectively mounted on two opposed sides of the worm gear (32) to be sandwiched between the wobbling wheel (34) and the driving gear (35). Each kneading plate (41) is provided with a rubber pad (42) mounted around an outer periphery of the kneading plate (41) and a foot (411) extending downward from a bottom of the kneading plate (41).

Each rubbing assembly (50) includes two bearings (500) respectively received in the front seat (141) and the rear seat (142), a driven axle (51) extending to the two bearings, a driven gear (52) securely and fixedly mounted around the driven axle (51) to correspond to and mate with the driving gear (35), and a disk (53) securely mounted on a free end of the driven axle (51) and having thereon two rubbing balls (54) integrally formed on a face of the disk (53).

Figure 4:
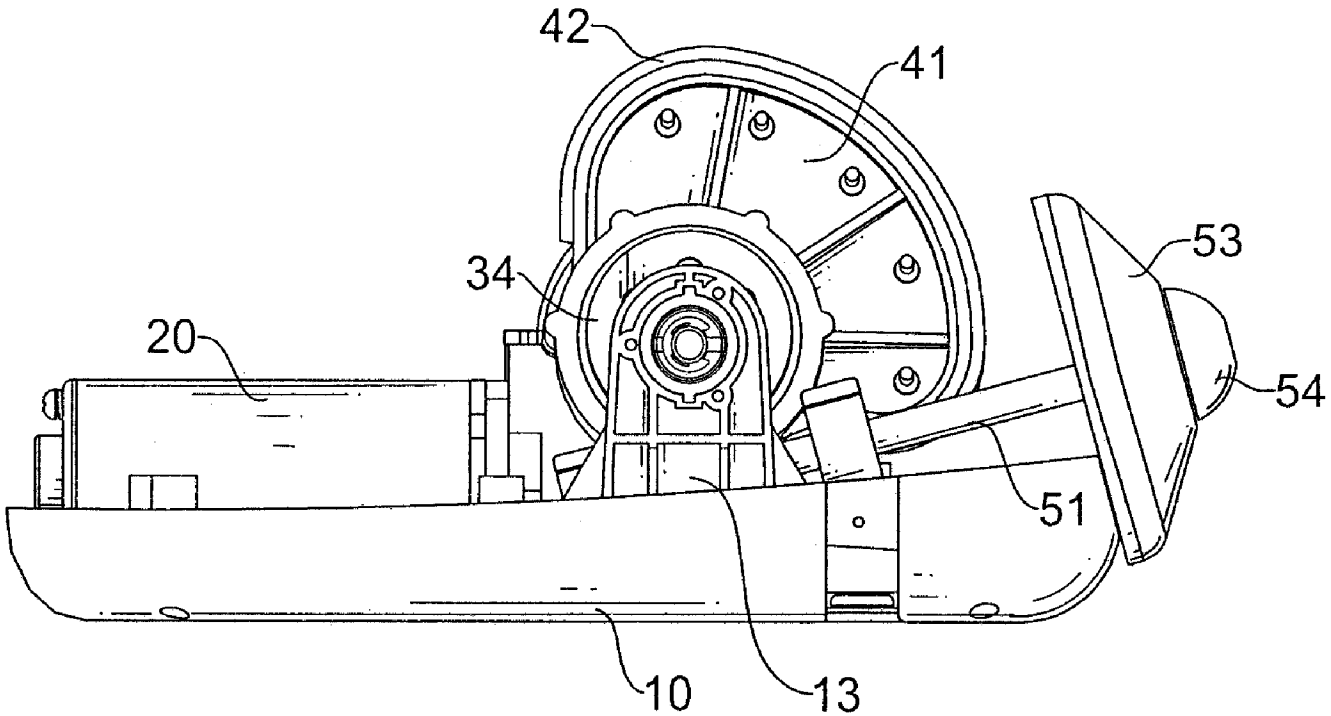
FIG. 4 is a side plan view showing the connection between the rubbing balls and the motor.
Figure 5:
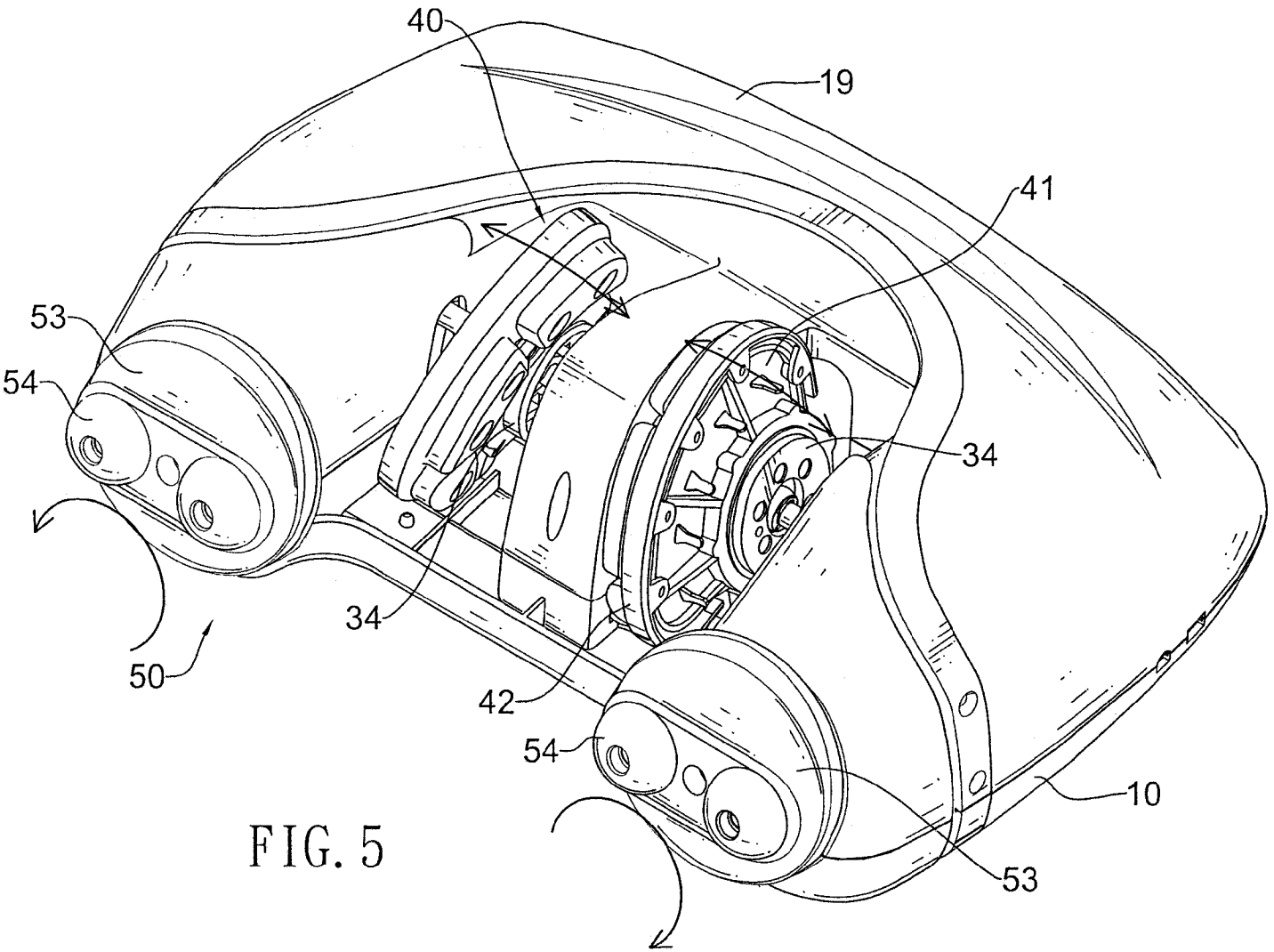
FIG. 5 is an operational perspective view of the massager in FIG. 1 showing the rotation of the rubbing balls and movement of the kneading plates.
Figure 6:
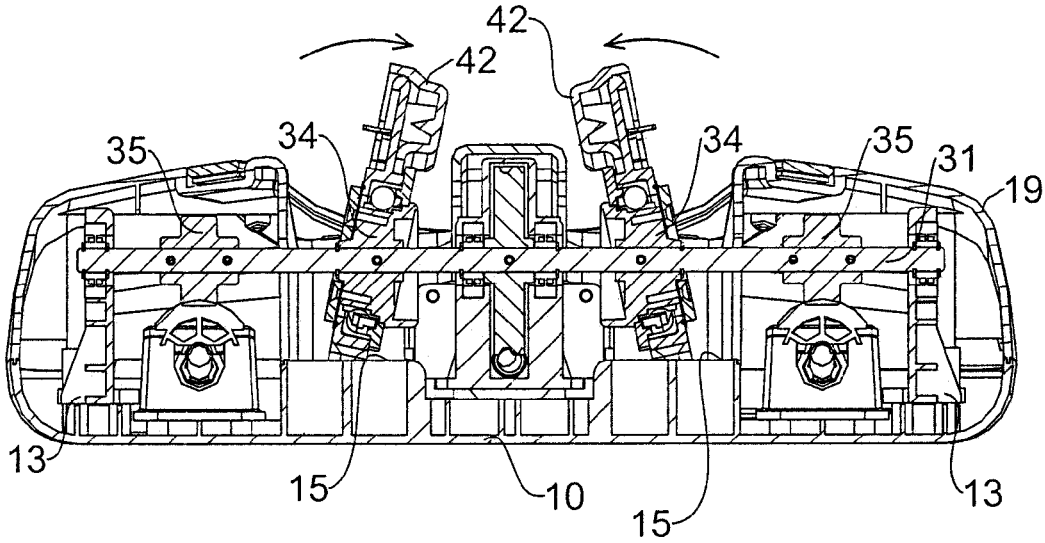
FIGS. 6 and 7 are cross sectional views showing the movement of the kneading plates due to an eccentric connection to the transmission axle of the present invention.
Figure 7:
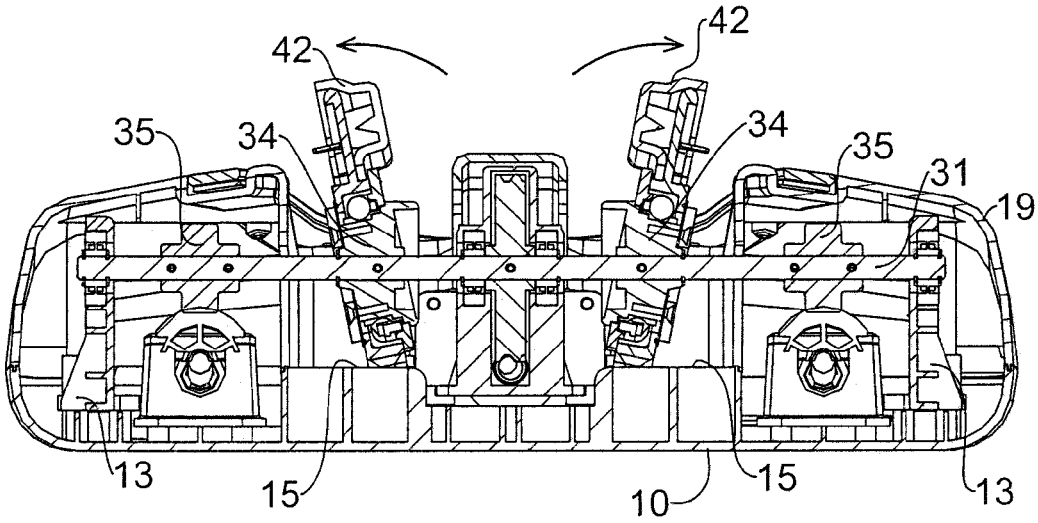
Figure 8:
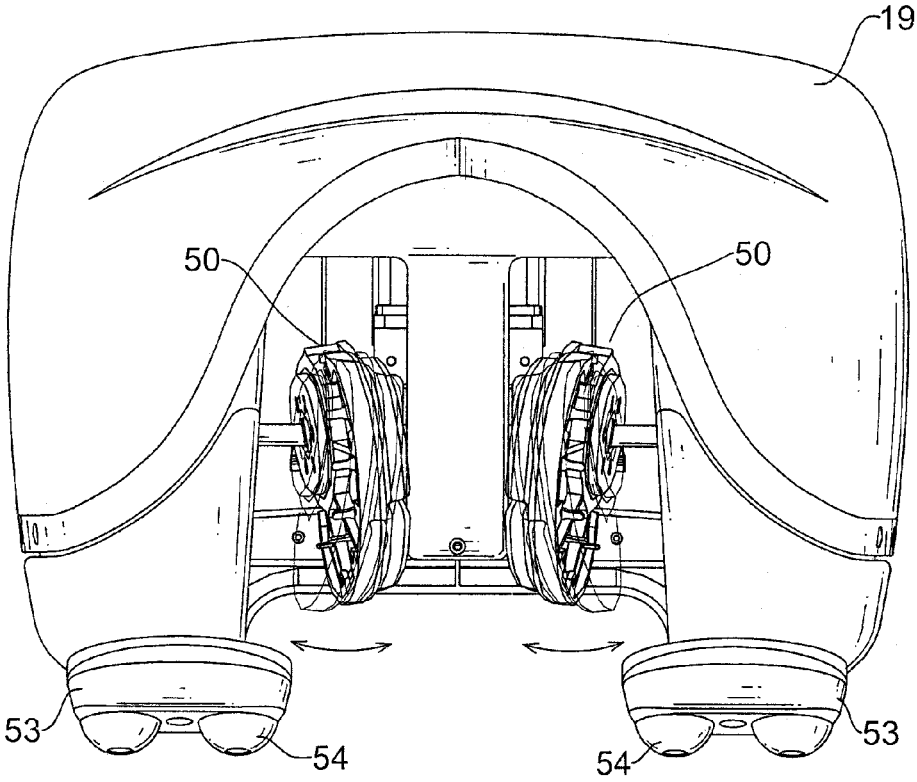
FIG. 8 is a top plan view showing the movement of the kneading plates.

Referring to FIGS. 2, 3 and taking FIG. 4 for reference, when the massager of the present invention is assembled, it is noted that the transmission axle (31) is extended through the wobbling wheel (34), the kneading plate (41), the driving gear (35) and connected to the side seat (13) with the kneading plate (41) mounted on the sleeve (341) of the wobbling wheel (34). Furthermore, the driving gear (35) is mated with the driven gear (52) and the foot (411) of each kneading plate (41) is received in one of the two guiding tracks (15). Because the sleeve (341) is eccentrically connected to the wobbling wheel (34), when the wobbling wheel (34) is rotated by the transmission axle (31), the sleeve (341) is wobbled relative to the wobbling wheel (34). Still, because the kneading plate (41) is mounted on the sleeve (341), the kneading plate (41) is also wobbled when the transmission axle (31) is rotated by a worm shaft (21) extending from the motor (20). Due to the mating interrelationship between the driving gear (35) and the driven gear (52), the disk (53) is also rotated. It is noted that the foot (411) is received in the guiding track (15) to limit movement of the foot (411). Therefore, when the kneading plate (41) is rotated due to the rotation of the transmission axle (31) and wobbled due to the connection to the sleeve (341), the foot (411) is limited within the guiding track (15) of the base (10).

With reference to FIGS. 5, 6, 7 and 8, it is noted that when the kneading plates (41) of the present invention are rotated and wobbled, the two disks (53) are also rotated but in different directions due to the connection between the driving gear (35) and the driven gear (52).

When the user is applying the massager of the present invention to a designated area of the body, such as the neck, the user is able to lean the neck again the protrusion (191) and thus the two kneading plates (41) are able to knead the neck muscles while the two rubbing balls (54) on the two disks (53) are able to rub the shoulder to simultaneously provide two different areas the massaging effect without moving the massager around the body.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A massager comprising:

a base having a central seat mounted on a central area of the base, two side seats respectively mounted on opposed sides of the central seat and a mediate seat integrally formed on the base and sandwiched between the central seat and the side seat;

a U shaped housing mounted on the base and provided with a protrusion integrally formed with the housing to divide an interior of the housing into a first receiving space and a second receiving space;

a motor received in the housing and having a worm shaft extending out of the motor;

a transmission assembly encased in the housing and including a transmission axle, a worm gear securely and fixedly mounted on the transmission axle to mate with the worm shaft, two wobbling wheels securely and fixedly mounted on the transmission axle and each wobbling wheel being respectively mounted on opposed sides of the worm gear and two kneading plates securely and fixedly mounted on the transmission axle and each kneading plate being connected to a corresponding one of the two wobbling wheels and each kneading plate to be wobbled relative to the corresponding wobbling wheel; and a rubbing assembly having two driven axles, two driven gears each securely and fixedly mounted on the driven axle to mate with a driving gear and two disks securely mounted on a free end of each driven axle and having two rubbing balls formed on a face of each of the disks, thereby after the transmission axle is extended through the wobbling wheels, the kneading plates, the driving gears, two ends of the transmission axle are respectively received in the side seats and the transmission axle drives the worm gear and the driving gears to rotate such that the kneading plates are wobbled and the disks are rotated due to the connection between the driving gears and the driven gears, wherein the rubbing assembly further has two bearings securely mounted on the driven axle and received in the mediate seat.

2. The massager as claimed in claim 1, wherein the mediate seat is provided with a front seat and a rear seat such that the two bearings are respectively received in the front seat and the rear seat.

3. The massager as claimed in claim 2, wherein the base further has two guiding tracks formed on the base and each kneading plate is provided with a foot integrally formed on a bottom of the kneading plate to be received in a corresponding one of the two guiding tracks so that when the kneading plates are wobbled, movements of the kneading plates are limited within the guiding tracks.

4. The massager as claimed in claim 2, wherein the wobbling wheel is provided with a sleeve eccentrically connected to the wobbling wheel and the kneading plate is securely mounted on the sleeve such that the kneading plate is wobbled when the wobbling wheel is driven to rotate by the transmission axle.

5. The massager as claimed in claim 3, wherein the wobbling wheel is provided with a sleeve eccentrically connected to the wobbling wheel and the kneading plate is securely mounted on the sleeve such that the kneading plate is wobbled when the wobbling wheel is driven to rotate by the transmission axle.

6. The massager as claimed in claim 1, wherein the base further has two guiding tracks formed on the base and each kneading plate is provided with a foot integrally formed on a bottom of the kneading plate to be received in a corresponding one of the two guiding tracks so that when the kneading plates are wobbled, movements of the kneading plates are limited within the guiding tracks.

7. The massager as claimed in claim 6, wherein the wobbling wheel is provided with a sleeve eccentrically connected to the wobbling wheel and the kneading plate is securely mounted on the sleeve such that the kneading plate is wobbled when the wobbling wheel is driven to rotate by the transmission axle.

8. The massager as claimed in claim 1, wherein the wobbling wheel is provided with a sleeve eccentrically connected to the wobbling wheel and the kneading plate is securely mounted on the sleeve such that the kneading plate is wobbled when the wobbling wheel is driven to rotate by the transmission axle.

* * * * *